United States Patent [19]

Bakermans

[11] Patent Number: 5,007,282

[45] Date of Patent: Apr. 16, 1991

[54] STAMPING AND FORMING MACHINE HAVING INTERCHANGEABLE PUNCH SUB-ASSEMBLY

[75] Inventor: Johannes C. W. Bakermans, Harrisburg, Pa.

[73] Assignee: AMP Incorporated, Harrisburg, Pa.

[21] Appl. No.: 467,095

[22] Filed: Jan. 18, 1990

[51] Int. Cl.[5] ..... B21D 37/04

[52] U.S. Cl. ..... 72/481; 83/698; 83/691

[58] Field of Search ..... 83/698, 691, 560; 72/481, 427, 344

[56] References Cited

U.S. PATENT DOCUMENTS 4,497,196 2/1985 Bakermans et al. .
4,733,552 3/1988 Lefils ..... 72/481
4,742,746 5/1988 Olsson ..... 83/691
4,819,476 4/1989 Bukermans et al. ..... 72/456

*Primary Examiner*—Lowell A. Larson
*Assistant Examiner*—Michael McKeon

[57] ABSTRACT

A punch assembly of a stamping and forming machine has a separate sub-assembly which is removably secured to the ram of the punch assembly. The sub-assembly comprises a punch holder, a stripper plate, and at least one punch. The stripper plate is coupled to the punch holder by a lost motion connection and the punch holder in turn is secured to the punch ram by fasteners. The fasteners are accessible through access openings which extend into the facial surface of the stripper plate. The practice of the invention permits the use of only one ram with a plurality of sub-assemblies and thereby reduces tooling costs.

20 Claims, 6 Drawing Sheets

STAMPING AND FORMING MACHINE HAVING INTERCHANGEABLE PUNCH SUB-ASSEMBLY

FIELD OF THE INVENTION

This invention relates to punch assemblies of the type used in stamping and forming machines and particularly to a punch assembly having a sub-assembly which interchangeable with similar sub-assemblies on the punch ram.

CROSS-REFERENCES TO RELATED PATENT PUBLICATIONS

The embodiment of the invention described below is particularly intended for use in a stamping and forming machine of the type shown in U.S. Pat. Nos. 4,819,476 and 4,497,196. These U.S. Patents are hereby incorporated by reference into the description of the present invention.

BACKGROUND OF THE INVENTION

U.S. Pat. No. 4,819,476 describes a punch assembly for a stamping and forming machine of the type shown in U.S. Pat. No. 4,497,196. The stamping and forming machine has a punch assembly and a die assembly mounted in a housing for movement towards and away from each other in a horizontal plane. The strip material, which is in a vertical plane, is fed along a strip feed path which extends between the opposed surfaces of the punch and die assemblies so that when these assemblies move against each other, the strip is blanked or formed in accordance with the punches and dies in the punch and die assemblies. The punch assembly comprises a punch ram having the individual punches mounted, in a punch holder, on the face thereof and a stripper plate which is located in front of the ends of the punches. The stripper plate is movable from a normal extended position relatively towards the punch ram when the tooling moves against the strip material. One of the advantageous features of a punch assembly as described in U.S. Pat. No. 4,819,476 is that the ends of the punches are recessed in openings in the stripper plate when the stripper plate is in its extended position and the punches are thereby protected against damage.

Punch assemblies of the type described in the above-identified U.S. Patent are presently being used to a substantial extent and are proving to be highly advantageous as compared with conventional punch and die sets in which the punches and dies are mounted on spaced-apart die shoes which in turn are mounted in a conventional vertical stamping and forming press.

Present design practice for a punch assembly for a machine of the type described in the above noted U.S. Patents requires that the entire punch assembly be an integrated unit comprised of the ram, the punch holder, the stripper plate, and other parts such as the coupling between the stripper plate and the punch ram. When a production run of a specific stamped and formed part has been finished and when a production run of a different part is to be started, the entire punch assembly is removed from the machine and replaced by a punch assembly having the tooling required for the different part which is to be produced. The use of integrated punch assemblies to produce a given stamped and formed part is not objectionable when extremely large numbers of the parts are required; however, if relatively limited numbers of a specific stamped and formed part are required, the manufacture of an entire punch assembly can constitute a relatively high tooling cost for the product.

The present invention is directed to the achievement of a punch assembly having the punch holder, the punches, and the stripper plate mounted on the punch ram as a removable sub-assembly. The tooling, particularly the punch and stripper plate portion of the tooling, required to produce the part can, therefore, in accordance with the present invention, be made at a substantially reduced cost as compared with previous methods of making such tooling.

THE INVENTION

The invention comprises a punch sub-assembly which is intended to be removably secured to a punch ram which is cooperable with a die assembly in a stamping and forming machine. The sub-assembly comprises punch holder means, stripper plate means, and at least one punch. The stripper plate means and the punch holder means are coupled to each other by lost motion coupling means which permits relative movement of the stripper plate means between an extended position and a retracted position with respect to the punch holder means. The stripper plate means is spaced from the punch holder means when in its extended position and is adjacent to the punch holder means when in its retracted position. The punch has a fixed end, an intermediate shank portion, and a free end. The fixed end is fixed to the punch holder means and the shank portion extends from the fixed end towards the stripper plate means and into an opening in the stripper plate means which conforms to the cross-section of the punch. Spring means are provided which serve to bias the stripper plate means to its extended position and fastener means are also provided for securing the punch holder means to a punch ram whereby a complete punch assembly results when the sub-assembly is assembled to a punch ram. The stripper plate means has a facial surface and a rear surface, the rear surface being opposed to the punch holder means. The free end of the punch is in the opening when the stripper plate means is in its extended position and the free end is located beyond, and spaced from, the facial surface when the stripper plate means is in its retracted position so that the free end of the punch is protected by the stripper plate means when the stripper plate is in its normal extended position.

In accordance with a further embodiment, the invention comprises a complete punch assembly which in turn comprises a punch ram and a punch sub-assembly as described above. The sub-assembly is removably secured to the punch ram by means of fasteners in the form of screws. Each screw has a screw head which is between the rear surface of the stripper plate means and the punch holder means. Each screw further has a shank, which extends rotatably through the punch holder means, and a threaded end which is threaded into the press ram. The stripper plate means has an access opening extending therethrough for each screw so that an Allen wrench or the like can be passed through the opening thereby to rotate the screw and remove the sub-assembly from the punch ram.

In accordance with a further embodiment, the invention comprises a stamping and forming machine comprising first and second tooling assemblies which are reciprocable relatively towards and away from each other, the first tooling assembly being a punch assembly comprising a punch ram, punch holder means, stripper plate means, and at least one punch. The punch has a fixed end and a free end, the fixed end being mounted in the punch holder means and the stripper plate means has an opening therein which is in alignment with, and which conforms to, the cross-section of the punch. The stripper plate means is movable between an extended and a retracted position as explained above relative to the punch holder means. The apparatus is characterized in that the punch holder means, the stripper plate means, and the punch are provided as a sub-assembly which is removably secured to the punch ram. The stripper plate means and the punch holder means are coupled to each other by a lost motion coupling which permits movement of the stripper plate means between its extended position and its retracted position and spring means are provided as described above between the stripper plate means and the punch holder means, the spring means serving to bias the stripper plate means to its extended position.

THE DRAWING FIGURES

Figure 9:
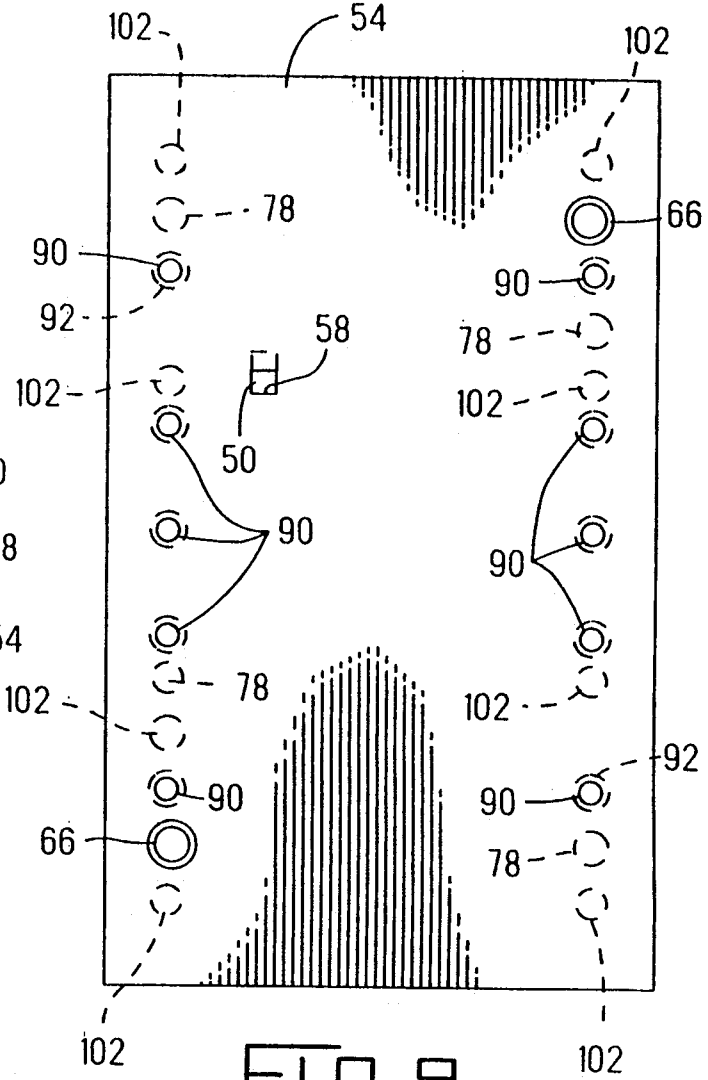
Figure 8:
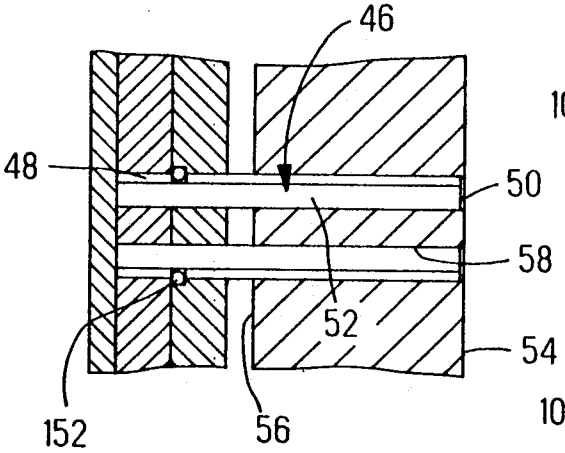
Figure 7:
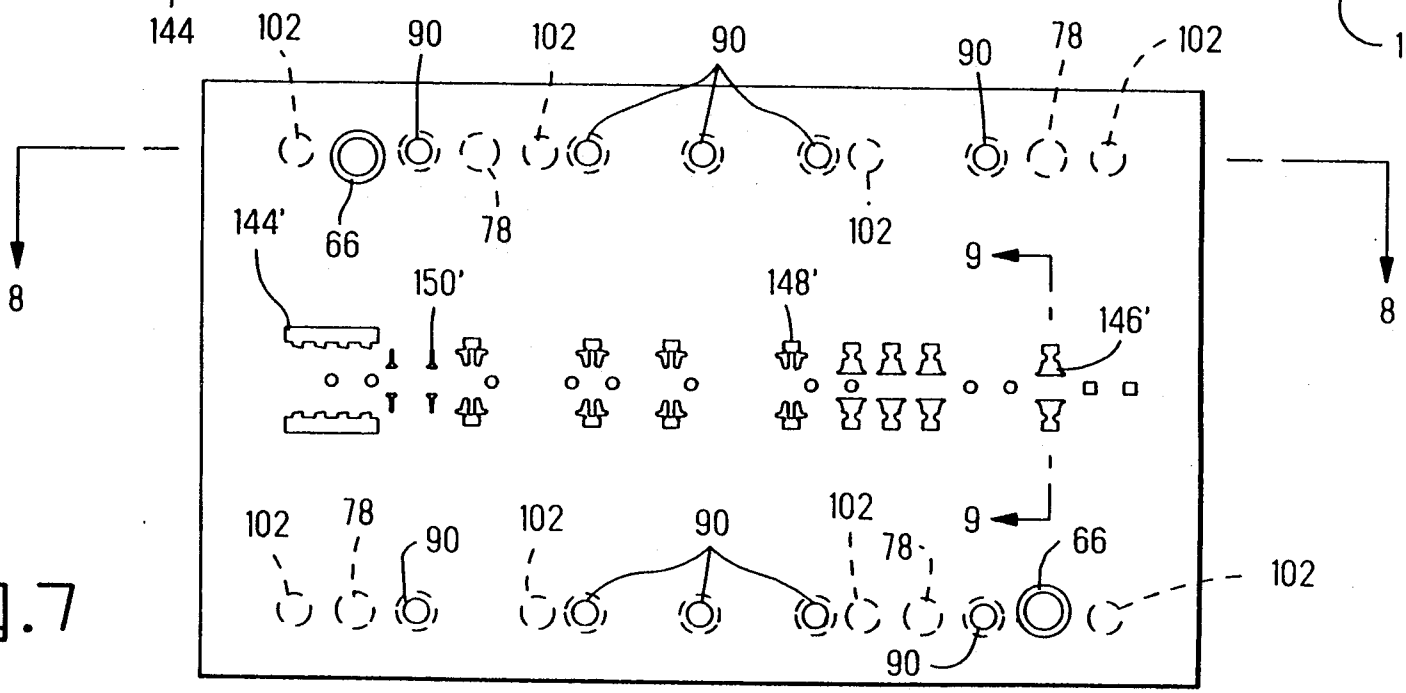
FIG. 7 is a view similar to FIG. 4 but showing the facial surface of a stripper plate of a punch assembly for producing the strip shown in FIG. 6.

FIGS. 8 and 9 are views looking in the direction of the arrows 8—8 and 9—9 of FIG. 7.

THE DISCLOSED EMBODIMENT

Figure 1:
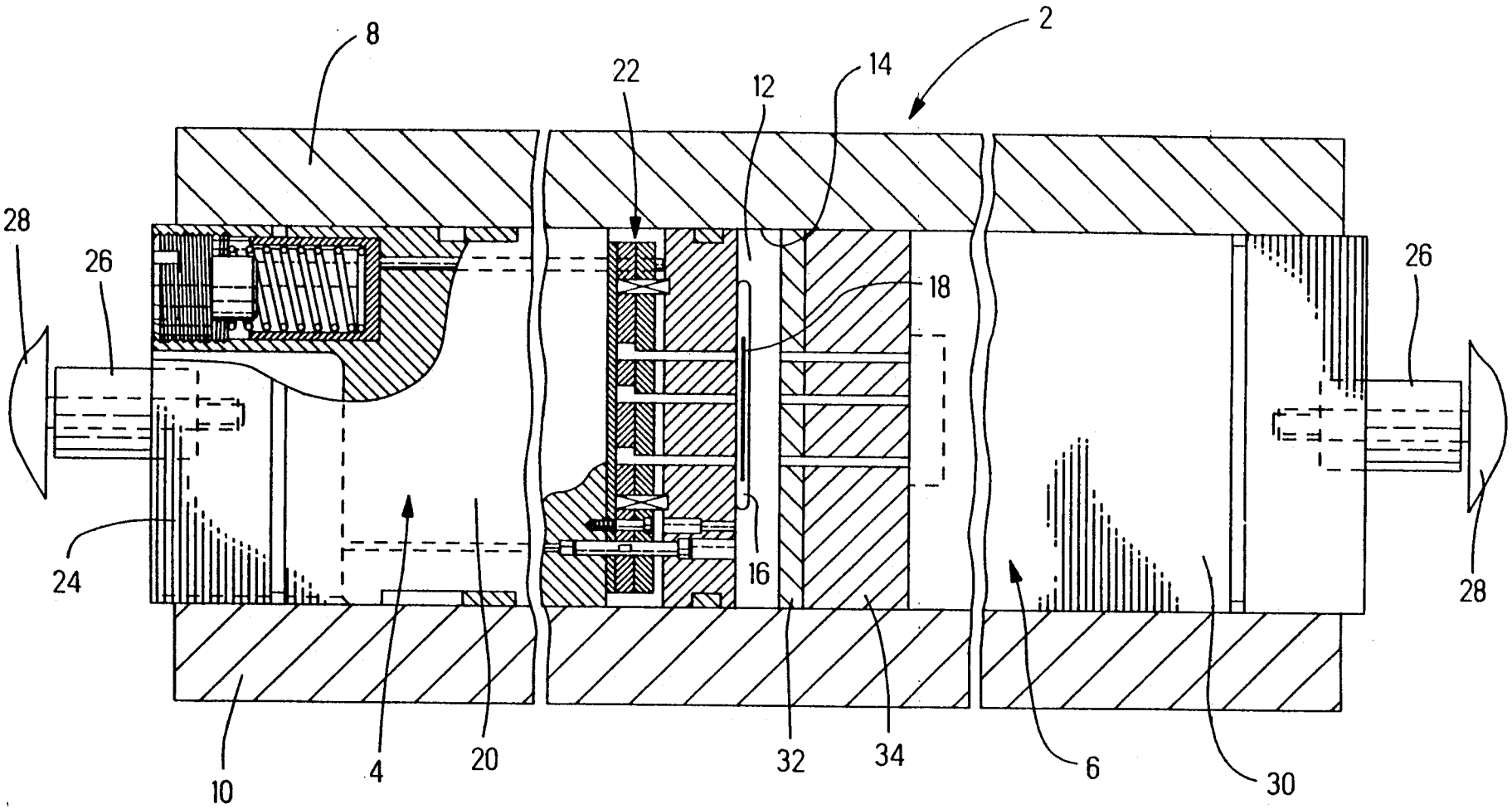
FIG. 1 is a cross-sectional view showing a punch assembly and a die assembly contained in a housing of a stamping and forming machine.

FIG. 1 shows a punch assembly 4 and a die assembly 6 which are contained in a housing 2 of a stamping and forming machine of the type described in U.S. Pat. Nos. 4,819,476 and 4,497,196. The housing 2 comprises housing top and bottom plates 8, 10 and side plates 12, one of which is visible in the background in FIG. 1. These housing plates define a rectangular passageway 14 in which the punch assembly and the die assembly are slidably contained for movement towards and away from each other. Strip material 18 (FIG. 6) is fed along a strip feed path through a slot !6 in the side plate 12. The path carries the strip between the opposed surfaces of the punch assembly and the die assembly and the strip is fed through a similar slot 16 in the other side plate 12 (not shown). During non-feeding intervals, the punch assembly and the die assembly move towards each other and perform punching operations on the strip as illustrated in FIG. 7.

The punch assembly comprises a punch ram 20 and a punch sub-assembly 22 which is described in detail below. A backplate 24 is mounted on the left-hand surface of the ram as viewed in FIG. 1 and is coupled by a coupling 26 to the upper end 28 of an actuator lever which moves the punch assembly to and fro during each operating cycle. The die assembly comprises a die ram 30, a die plate 32, and a die backup plate 34 which is between the die plate and the die ram. These parts are secured together by suitable fasteners and may be as described in U.S. Pat. No. 4,819,476.

Figure 2:
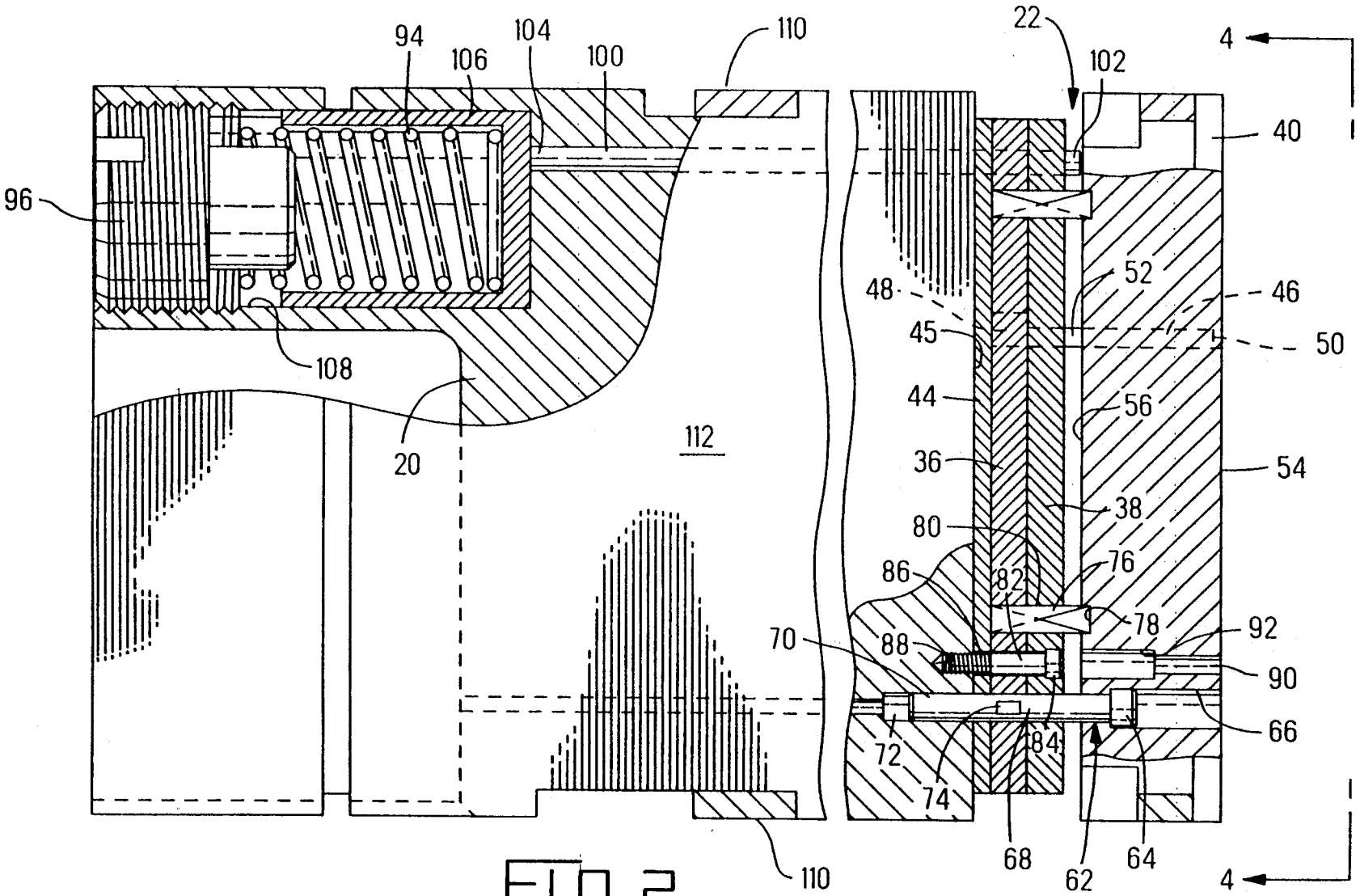
FIG. 2 is a view on an enlarged scale of a punch assembly; this view is intended to illustrate the principles of the, invention and does not show all of the details of a working embodiment.
Figure 3:
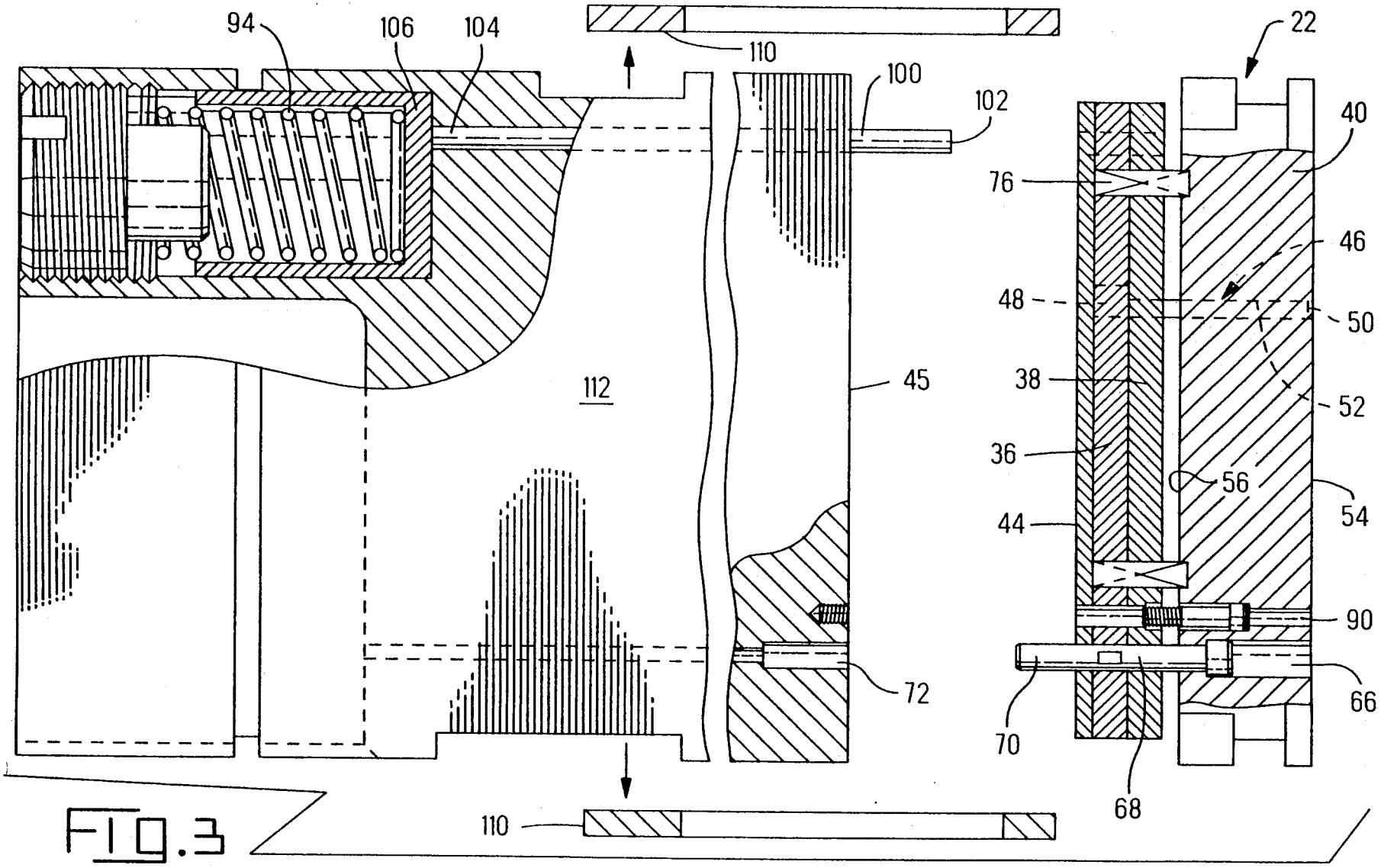
FIG. 3 is a view similar to FIG. 2 but showing the punch sub-assembly removed from, and in alignment with, the punch ram.
Figure 4:
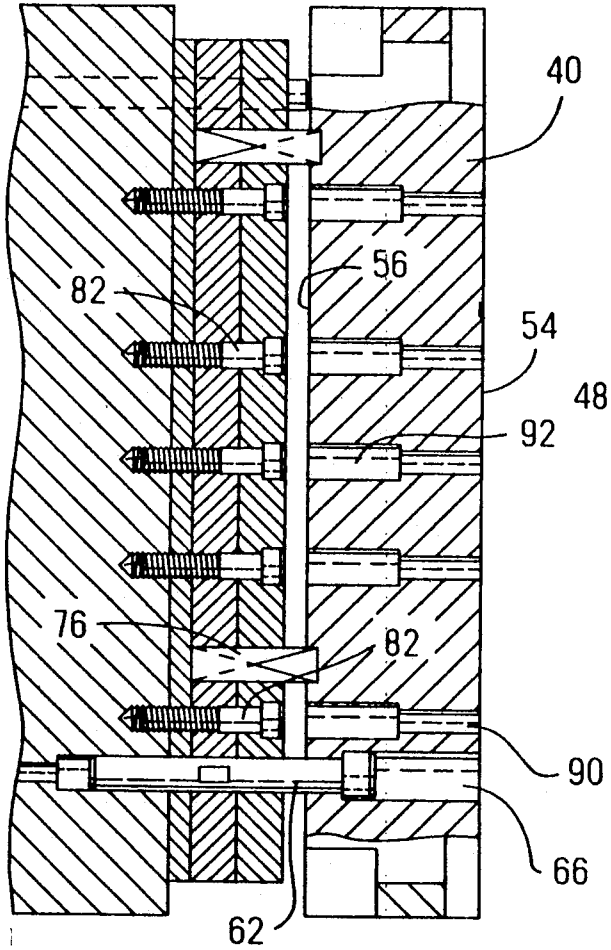
FIG. 4 is a view looking in the direction of the arrows 4—4 of FIG. 2 showing the facial surface of the stripper plate.

FIGS. 2–4 show the essential features of the sub-assembly 22 but do not show all of the structural features of an actual working embodiment which is shown in FIGS. 7–9. The sub-assembly comprises punch holder means which in turn comprises a punch holder plate 36 and a punch retainer plate 38, these two plates being secured to each other and mounted against a hardened steel backup plate 44 which is interposed between the plate 36 and the face 45 of the ram 20. A single punch 46 is shown in FIG. 2 which has a fixed end 48, a free end 50, and a shank portion 52. The fixed end is enlarged and is retained in an opening in the plate 36 by the retainer plate 38 through which the intermediate shank portion extends.

The stripper plate 40 has a facial surface 54 and a rear surface 56 which is opposed to the surface of the retainer plate 38. A hole 58 (FIG. 4) extends through the stripper plate which conforms to the cross-section of the punch and the free end 50 of the punch is located in this hole and recessed from the facial surface 54 when the stripper plate is in its normal or extended position. When the stripper plate is moved leftwardly as viewed in FIG. 2 towards the retainer plate, the free end projects beyond the facial surface and would be in engagement with the stock material 18 during operation of the machine.

The stripper plate 40 is coupled to the punch holder means by a lost motion coupling comprising coupling pins 62, each of which has a head 64 which is located in the counterbore 66 of an opening which extends inwardly from the facial surface 54 of the stripper plate. The intermediate shank portion 68 of the coupling pin extends through the reduced diameter portion of the opening in the stripper plate 40 and into aligned openings in the retainer plate 38 and the punch holder plate 36. The pin 62 is secured to the punch holder plate by means of a suitable set screw as indicated at 74. The coupling pin has an end portion 70 which extends through an opening in the backup plate 44 and into a hole 72 in the punch ram. This end portion serves an aligning function when the sub-assembly is removed from, or mounted on, the punch ram 20.

The stripper plate is normally biased to the position shown in FIG. 2 by spring means as indicated at 76. The end of each spring is received in a recess 78 in the surface 56 of the stripper plate and the spring extends through aligned holes 80 in the punch holder plate and the retainer plate 38 and bears against the surface of the backup plate 44.

As will be described in detail below, a plurality of springs 76, a plurality of coupling pins 62, and a plurality of fasteners 82 are provided in the working embodiment which is shown in FIGS. 7 and 8.

The sub-assembly 22 is removably secured to the face of the ram 20 by fasteners 82. Each fastener has a head 84 which is between the surface of the retainer plate 38 and the surface 56 of the stripper plate 40. An intermediate shank portion 86 of the fastener extends through holes in the retainer plate 38, the punch holder plate 36, and the backup plate 44. The end portion 88 of the fastener is threaded into a threaded opening in the face of the punch ram 20. The head 84 of the fastener has a recess shaped and dimensioned to receive an Allen wrench or the like and is accessible by means of an access opening 90 which extends inwardly from the facial surface 54 of the stripper plate and which is in alignment with the head of the fastener. This opening is counterbored as shown at 92 and the enlarged head 84 of the fastener is received in this counterbore when the sub-assembly is disassembled from the ram 20.

The springs 76 are relatively weak springs and their primary purpose is to maintain the stripper plate 40 in its extended position when the sub-assembly 22 is removed from the punch ram. Under at least some circumstances, such as when a large number of punches are mounted on the punch ram, the relatively weak springs 76 would not be capable of moving the stripper plate from its retracted position to its extended position and thereby push the strip off of the ends of the punches. A plurality of relatively stiff springs 94 are provided to carry out the operation of stripping the metal strip from the punches.

The spring 94 shown in FIG. 2 biases a stripper rod 100 against the surface 56 of the stripper plate when the stripper plate is in its retracted position. The stripper rod 100 has an end 102 which is normally spaced from the stripper plate by a very slight distance for reasons discussed below. The stripper rod extends through an opening in the punch ram and has a left-hand end 104, as viewed in FIG. 2, which bears against a cup-like spring housing 106 which is slidably contained in a bore 108 that extends inwardly from the left-hand end of the ram 20. The spring 94 is contained in the housing 106 and is urged against its inner wall by a plug 96 that is threaded into the end of the bore 108.

During an operating cycle of the machine, the punch and die assemblies move relatively towards and away from each other from the positions of FIG. 1. After the surface 54 is against the face of the die assembly, the stripper plate 40 moves relatively leftwardly (while the punch ram and punch continue to move rightwardly) until the surface of the 56 is against the surface of plate 38. The punch is thereby moved beyond the surface 54 and punches a hole in the strip. During return movement of the punch and die assemblies to the positions of FIG. 1, the stiff springs 94 move the stripper plate 40 rightwardly relative to the ram block while the ram block is moving leftwardly. During this final interval of the cycle, the springs 94 push the strip off of the end of the punch.

Figure 5:
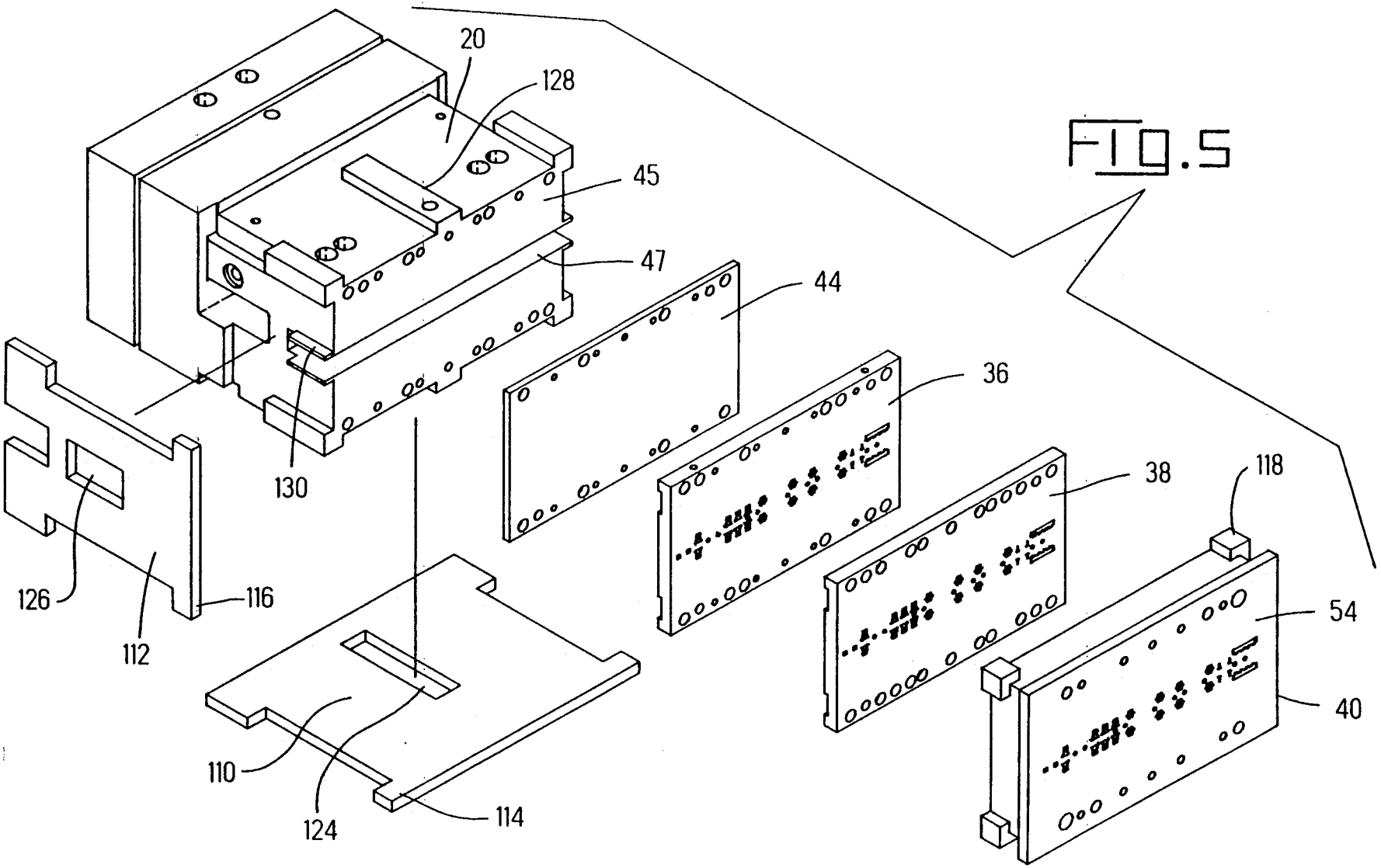
FIG. 5 is a perspective exploded view of the punch assembly.

As explained in U.S. Pat. No. 4,819,476, bearing plates 110 are mounted on the upper and lower surfaces of the punch ram and plates 112 on the side surfaces thereof. These plates are interposed between portions of the surface of the passageway in the housing and the surfaces of the ram block. The plates 110, 112 are secured to the stripper block by means of ears 114 on the leading ends of the plates 110 and ears 116 on the leading ends of the plates 112. These ears are received behind projecting ears 118 on the corners of the stripper plate 40 as shown in FIGS. 2 and 5. The plates 110, 112 thus extend leftwardly, as viewed in FIG. 2, from the stripper plate over the surfaces of the ram block and over the edges of the punch retainer plate and the punch mounting plate. The plates 110, 112 have rectangular openings 124, 126 therein, respectively. The openings 124 receive rectangular projections 128 on the upper and lower surfaces of the punch ram block. The projections 128 are shorter (as measured in the direction of movement of the punch ram) than the openings 124 so that limited movement of the plates relative to the surfaces of the punch ram can take place when the stripper plate moves from its extended position to its retracted position. The projections 128 and the openings 124 constitute a second lost motion connection between the stripper plate 40 and the punch ram 20 and this second lost motion coupling is effective along with the lost motion coupling of the coupling pins 62.

The openings 126 in the plates 112 are clearance openings for ears 130 which extend from a transverse slot 47 in the face 45 of the punch ram. The slot 47 is provided to receive a yoke bar (not shown) to which the pilot pins are secured as described in U.S. Pat. No. 4,819,476. The pilot pins and the pilot pin actuator means, which includes the yoke bar, are not shown in the drawing for the reason that they are not part of the present invention.

During an operating cycle of the stamping and forming machine, the punch assembly and the die assembly move towards each other during a non-feeding interval of the strip material and the punches move against the strip and into openings in the die assembly to produce holes in the strip material. During such movement, the stripper plate moves relatively towards the punch ram and towards the punch holder means so that the end of the punch will project beyond the surface 54 of the stripper plate. The spring 94 is compressed after the rear surface 56 of the stripper plate moves against the end 102 of the rod 100 and during return movement of the punch assembly, to its position as shown in FIG. 1, the spring 94 pushes the rod 100 against the stripper plate to push the strip material from the end of the punch.

When it is necessary to remove the sub-assembly 22 from the punch ram, the entire punch assembly 4 is removed from the housing 2 and the bearing plates 110, 112 are removed from the punch ram and the sub-assembly. This operation is carried out by merely pushing on the surface 54 of the stripper plate so that the projections 128, 130 will not be spring biased (by springs 76) against the ends of the rectangular holes 124, 126. In other words, when the parts are in their normal position, it would be difficult to remove the plates 110, 112 from the ram and the sub-assembly because of the fact that these plates are resiliently biased to the position shown in FIG. 1 by springs 76.

As previously mentioned, the end 102 of the rod 100 is normally spaced from the surface 56 of the stripper plate. This slight gap is provided in order to permit easy removal of the plates from the ram and the sub-assembly; if the gap were not provided, the rod 100 would be urged against the surface 56 under the influence of the extremely stiff spring 94. Under those circumstances, it might be extremely difficult for the technician to push the stripper plate leftwardly from its position shown in FIG. 2 against the biasing force of the spring 94. In fact, it would probably be necessary for the technician to loosen the threaded plug 96 and relieve the pressure of the spring 94 and this operation would then necessitate resetting or readjusting the plug during subsequent assembly of the punch assembly. If the gap between the end 102 of rod 100 and surface 56 is provided, the technician, when pushing the stripper plate leftwardly, must overcome only the relatively weak springs 76.

After the plates 110, 112 have been removed, the technician merely disengages all of the fasteners 82 by inserting a wrench through each of the openings 90 and rotating the screws to back off the screws from their threaded openings in the punch ram. The entire sub-assembly 22 can then be moved rightwardly to the position of FIG. 3 and replaced by another sub-assembly. When the sub-assembly is removed from the ram, the stripper plate will be maintained in the position shown in FIG. 3 by the springs 76 and the ends 50 of the punches will thereby be protected.

Figure 6:
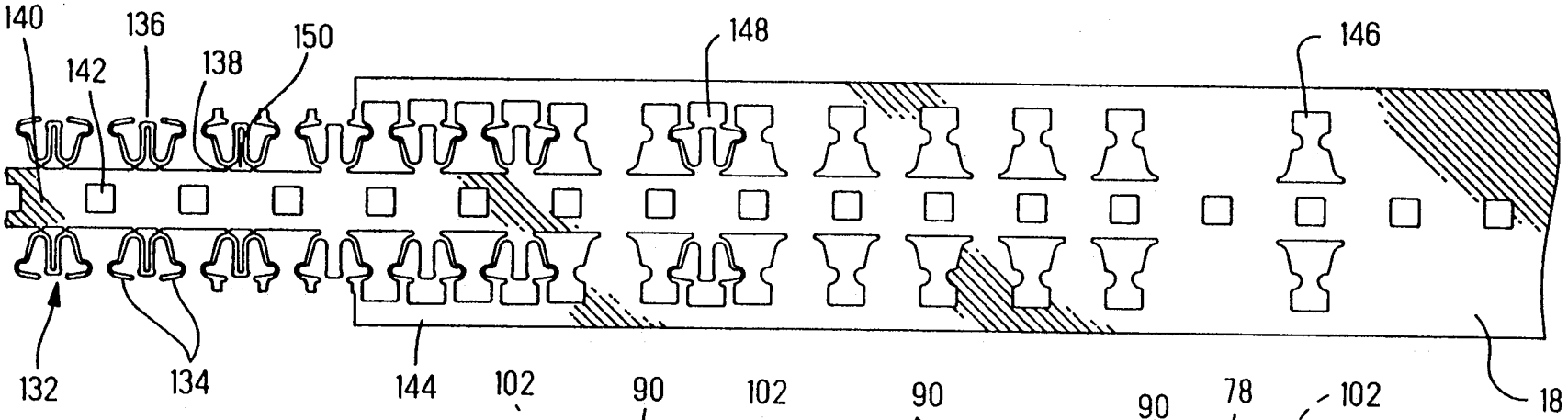
FIG. 6 is a plan view of a strip progression which illustrates the successive steps in producing a stamped contact member.

FIG. 6 shows a progression which illustrates the several stamping steps in the production of contact terminals 132. The strip shown comprises a central carrier strip 140 having spaced-apart pilot holes 142. Each of the side edges of the carrier strip has spaced-apart terminals 132 extending therefrom and connected thereto by connecting sections 138. Each terminal has two spring members 134 which are integral with a central U-shaped section 136. FIG. 7 shows the facial surface of a stripper plate of an actual sub-assembly containing the punches and other tooling necessary to produce the strip shown in FIG. 6. The individual contact terminals 132 are produced by punching a series of holes 146, 148, 150 in the strip 18 as shown in FIG. 6. The openings in the stripper plate 40 which receive the punches which produce the openings 146, 148, 150 are shown in FIG. 7 at 146', 148', and 150'. Additionally, punches are provided as shown at 144, which remove portions of the edge carrier strips 144 in the final operation.

FIG. 9 shows a preferred method of retaining the individual punches in the punch holder. As shown in FIG. 8, small pins 152 are provided in the retainer plate which are received in notches in the fixed ends of the punches thereby to prevent any movement of the punches relative to the retainer plate or the punch holder plate. The openings which receive the ends of the punches in the punch holder plate are precisely dimensioned with respect to the cross-sections of the punches.

FIG. 8 shows one side of the punch assembly and illustrates the positioning of the biasing springs, the fasteners, and the coupling pins.

It will be apparent from the foregoing description that a single punch ram 20 can be used with a large number of interchangeable punch sub-assemblies 22 and that substantial economies can be realized in the manufacture of punch assemblies if the principles of the present invention are employed.

While the invention is described above as an embodiment useful in a stamping and forming machine of the type shown in U.S. Pat. No. 4,497,196, the principles of the invention can be used in die sets which in turn would be used in a conventional stamping press in which the press ram moves vertically towards and away from a fixed die assembly.

What is claimed is:

1. A punch sub-assembly which is intended to be removably secured to a reciprocable punch ram which is cooperable with a die assembly in a stamping and forming machine, the sub-assembly comprising:

punch holder means, stripper plate means, and at least one punch, the stripper plate means and the punch holder means being coupled to each other by lost motion coupling means which permits relative movement of the stripper plate means between an extended position and a retracted position with respect to the punch holder means, the stripper plate means being spaced from the punch holder means when in its extended position and being adjacent to the punch holder means when in its retracted position, the punch has a fixed end, an intermediate shank portion, and a free end, the fixed end being fixed to the punch holder means, the shank portion extending from the fixed end towards the stripper plate means and into an opening in the stripper plate means which conforms to the cross-section of the punch, spring means serving to bias the stripper plate means to its extended position, fastener means for securing the punch holder means to a punch ram, and aligning pin means secured to the punch holder means and extending therefrom in the direction which is opposite to the direction of the punch, the aligning pin means having an end portion which is dimensioned for reception in an aligning hole in a punch ram whereby, a complete punch assembly is produced when the sub-assembly is secured to a punch ram.

2. A punch sub-assembly as set forth in claim 1 characterized in that the aligning pin means is integral with the lost motion coupling means.

3. A sub-assembly as set forth in claim 1 characterized in that the punch holder means comprises a punch holder plate and a retainer plate, the punch having its fixed end fixed in the punch holder plate and having a shank portion which extends through the retaining plate whereby the fixed end is captured in the punch holder plate by the retaining plate.

4. A sub-assembly as set forth in claim 1 characterized in that the stripper plate means has a facial surface and a rear surface, the rear surface being opposed to the punch holder means, the free end of the punch being in the opening when the stripper plate means is in its extended position, the punch extending through the stripper plate means so that the free end is spaced from the facial surface when the stripper plate means is in its retracted position whereby, the free end of the punch is protected by the stripper plate means when the stripper plate is in its extended position.

5. A sub-assembly as set forth in claim 4 characterized in that the punch holder means has one surface which is opposed to the punch ram when the sub-assembly is mounted on a ram, the fastener means being supported in the punch holder means and extending past and from the one surface, the stripper plate means has an access opening extending therethrough from the facial surface to the rear surface for providing access to the fastener means when the sub-assembly is mounted on, or removed from, a punch ram.

6. A sub-assembly as set forth in claim 5 characterized in that the fastener means comprises a screw having a screw head and a threaded end, the screw head being accessible through the access opening.

7. A sub-assembly as set forth in claim 4 characterized in that the lost motion coupling means comprises a coupling pin which is secured to the punch holder means, the coupling pin extending through an opening in the stripper plate means, the opening having a counterbore extending inwardly from the facial surface of the stripper plate means, the coupling pin having an enlarged head which is in the counterbore, the stripper plate means being slidably supported on the coupling pin.

8. A sub-assembly as set forth in claim 7 characterized in that the punch holder means has one surface which is opposed to the ram when the sub-assembly is mounted on a ram, the coupling pin having an end portion which extends from the punch holder means past the one surface, the end portion being dimensioned for reception is a hole in the punch ram.

9. A sub-assembly as set forth in claim 4 characterized in that the punch holder means comprises a punch holder plate and a retainer plate, the punch being captured in the punch holder plate by the retainer plate, the punch holder means having one surface which is opposed to a punch ram when the sub-assembly is mounted on a ram, the fastener means comprising a screw having a threaded end, a screw head, and an intermediate portion, the intermediate portion being supported in the punch holder means, the threaded end extending past the one surface, the screw head being between the rear surface of the stripper plate means and the punch holder means, the stripper plate means having an access opening extending therethrough to provide access to the screw head, the lost motion coupling means comprising a coupling pin which is secured to the punch holder means, the coupling pin extending through an opening in the stripper plate means, the opening having a counterbore extending inwardly from the facial surface of the stripper plate means, the coupling pin having an enlarged head which is in the counterbore, the stripper plate means being slidably supported on the coupling pin, the coupling pin having an end portion which extends from the punch holder means past the one surface, the end portion being dimensioned for reception in a hole in a punch ram.

10. A sub-assembly as set forth in claim 9 characterized in that a plurality of coupling pins and a plurality of screws are provided.

11. A punch assembly which is intended for use with a die assembly in a stamping and forming machine, the punch assembly comprising a punch ram, punch holder means, stripper plate means, and at least one punch, the punch having a fixed end and a free end, the fixed end being mounted in the punch holder means, the stripper plate means having an opening therein which is in alignment with, and which conforms to, the cross-section of, the punch, the stripper plate means being movable between an extended position and a retracted position relative to the punch holder means, the free end of the punch being in the opening when the stripper plate means is in its extended position, the free end of the punch extending past the stripper plate means when the stripper plate means is in its retracted position, the punch assembly being characterized in that:

- the punch holder means, the stripper plate means, and the punch are provided as a sub-assembly which is removably secured to the punch ram,
- the stripper plate means and the punch holder means are coupled to each other by a lost motion coupling which permits movement of the stripper plate means between its extended position and its retracted position,
- the punch holder means comprises a punch holder plate and a retainer plate, the punch having its fixed end fixed in the punch holder plate and having a shank portion which extends through the retaining plate whereby the fixed end is captured in the punch holder plate by the retaining plate, and
- spring means are provided between the stripper plate means and the punch holder means, the spring means serving to bias the stripper plate means to its extended position whereby, the sub-assembly can be removed from the punch ram and replaced by a different sub-assembly, and after removal, the stripper plate means will be maintained in its extended position by the spring means and the free ends of the punch will thereby be protected from damage.

12. A punch assembly as set forth in claim 11 characterized in that the stripper plate means has a facial surface, which is opposed to the die assembly and a rear surface which is opposed to the punch holder means, the spring means being between the rear surface and punch holder means.

13. A punch assembly as set forth in claim 12 characterized in that the sub-assembly is secured to the punch ram by fastener means which extends through the punch holder means and into the punch ram, the stripper plate means having access opening means extending therethrough from the facial surface to the rear surface, the access opening means being in alignment with the fastener means thereby to permit access to the fastener means when the sub-assembly is secured to, or removed from, the punch ram.

14. A punch assembly as set forth in claim 13 characterized in that the fastener means comprises at least one screw having a screw head and a threaded end, the threaded end being threaded into the press ram, the screw head being accessible from the facial surface of the stripper plate means through the access opening means.

15. A punch assembly as set forth in claim 14 characterized in that a plurality of screws are provided and the access opening means are counterbored at the rear surface of the stripper plate means, the screw heads being received in the counterbores when the sub-assembly is removed from the ram.

16. A punch assembly as set forth in claim 12 characterized in that the lost motion coupling comprises a coupling pin having an enlarged head, a shank portion, and an end portion, the stripper plate means having an opening extending therethrough from the facial surface to the rear surface, the opening having a counterbore extending inwardly from the facial surface, the opening having a reduced diameter portion extending from the counterbore to the rear surface, the head portion being in the counterbore, the shank portion extending through the reduced diameter portion and into the punch holder means, the stripper plate means being slidable on the shank portion and the shank portion being secured to the punch holder means.

17. A punch assembly as set forth in claim 16 characterized in that the shank portion extends through aligned openings in the punch holder means and into an opening in the punch ram.

18. A punch assembly as set forth in claim 11 characterized in that the lost motion coupling comprises coupling pin means which is secured to the punch holder means and which extends into the stripper plate means, the stripper plate means being slidable on the coupling pin means, the coupling pin means having one end which is captured by the stripper plate means.

19. A punch assembly as set forth in claim 11 characterized in that the stripper plate means has a facial surface which is opposed to the die assembly and a rear surface which is opposed to the punch holder means, the spring means being between the rear surface and the punch holder means, the sub-assembly being secured to the punch ram by at least one fastener which extends through the punch holder means and into the punch ram, the stripper plate means having access opening means extending therethrough from the facial surface to the rear surface, the access opening means being in alignment with the fastener means thereby to permit access to the fastener means when the sub-assembly is secured to, or removed from the punch ram, the lost motion coupling means comprises a coupling pin having an enlarged head, a shank portion, and an end portion, the stripper plate means having a coupling pin hole extending therethrough, the coupling pin hole having a counterbore extending inwardly from the facial surface, the coupling pin extending through the coupling pin hole with the enlarged head in the counterbore, the shank portion extending through, and being secured to, the punch holder means, and the end portion extending into the punch ram.

20. A punch assembly as set forth in either of claims 10 or 19 characterized in that the punch assembly has a rectangular cross-section and has side plates on at least two opposite sides thereof, the side plates being secured to the stripper plate means and extending past the punch holder means and over the ram, the side plates being slidable over the punch holder means and the ram when the stripper plate means moves between its extended and retracted positions, the spring means constituting a biasing spring means, and a resiliently biased stripper rod means is provided which extends slidably through the punch ram and the punch holder means, the stripper rod means having one end which is adjacent to, and spaced from, the stripper plate means when the stripper plate means is in its extended position, and stripper spring means are provided for urging the stripper rod means towards the punch holder means.

* * * * *